United States Patent [19]

Anderson

[11] 4,189,999

[45] Feb. 26, 1980

[54] VECTOR ACOUSTIC MINE MECHANISM

[75] Inventor: Lloyd D. Anderson, Takoma Park, Md.

[73] Assignee: The United States of America as represented by the Secretary of the Navy, Washington, D.C.

[21] Appl. No.: 569,662

[22] Filed: Mar. 5, 1956

[51] Int. Cl.[2] ..... F42B 22/04

[52] U.S. Cl. ..... 102/18 R

[58] Field of Search ..... 102/18; 114/21.3; 340/6

[56] References Cited

U.S. PATENT DOCUMENTS

| | | | |
|---|---|---|---|
| 1,364,615 | 1/1921 | Da Cruz | 102/18 |
| 1,390,768 | 9/1921 | Dorsey | 102/18 |
| 2,166,991 | 7/1939 | Guanella | 114/21 |
| 2,435,253 | 2/1948 | Turner, Jr. | 340/6 |
| 2,529,658 | 11/1950 | Massa | 340/6 |
| 2,530,528 | 11/1950 | Kreer, Jr. | 114/21 |

*Primary Examiner*—Charles T. Jordan

*Attorney, Agent, or Firm*—R. S. Sciascia; A. L. Branning

EXEMPLARY CLAIM

1. A submarine mine actuating system responsive to the acoustic pressure signature of a target vessel moving through the water in the vicinity of the system comprising; an array of hydrophones including a first velocity hydrophone having a cosine response pattern and generating an electric signal in response to received underwater acoustic signals originating from said target vessel, and second velocity hydrophone having a response pattern similar to that of said first hydrophone and disposed in orthogonal relation therewith whereby the axes of maximum sensitivity of said hydrophones are mutually perpendicular so that the signals produced by said hydrophones undergo a phase reversal as the target vessel crosses an axis of maximum sensitivity of one of said hydrophones; a pair of transformers each having a primary coil coupled to the output of a respective one of said hydrophones to receive an output signal therefrom, a ring demodulator circuit having a first and a second pair of input terminals each connected across the respective secondaries of said transformers, a center-tap at each secondary winding of said transformers for providing an output signal from said demodulator circuit correlative to the phase relationship of the signals applied across the input terminals of said circuit to thereby indicate a phase reversal of the received acoustic signal as the target vessel crosses the axis of one of said hydrophones of said array.

5 Claims, 9 Drawing Figures

FIG.1.
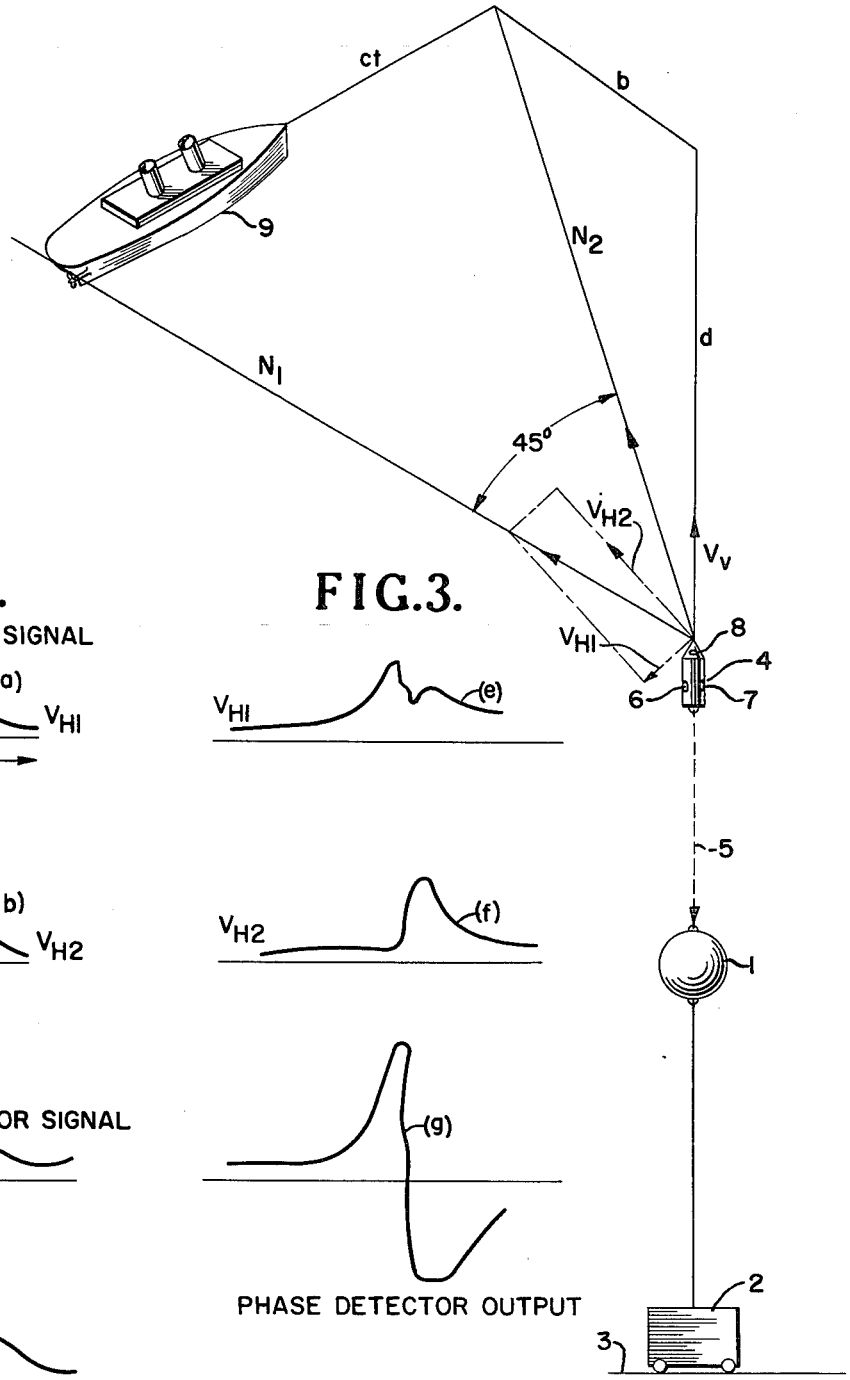
FIG.2.
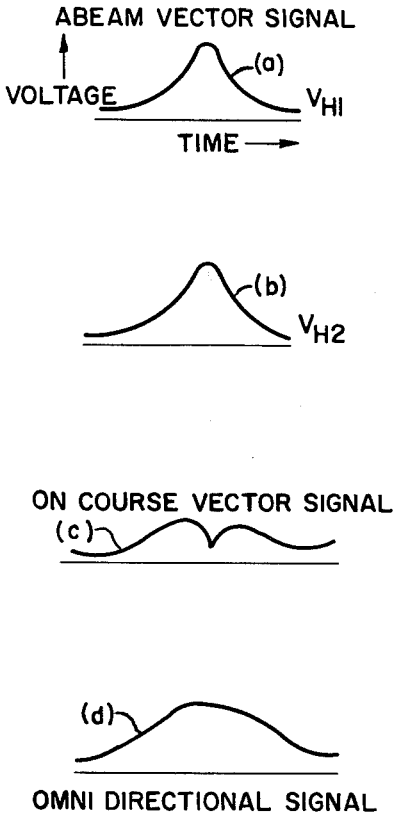
FIG.3.

VECTOR ACOUSTIC MINE MECHANISM

The invention described herein may be manufactured and used by or for the Government of the United States of America for governmental purposes without the payment of any royalties thereon or therefor.

This invention relates to a passive system or mechanism for providing vector acoustic mine firing from a scalar sound pressure field, in which the properties of the velocity field characteristics of acoustic signals emitted by a ship in the vicinity of the mine are utilized to advantage to increase the effective signal to noise ratio so as to provide effective mine firing for slow speed, quiet vessels operating at 6 knots or less, such as battery operated submarines, and to maintain good anti-countermine and countermeasure protection of the mechanism. The method of firing to which this system relates renders the actuation characteristics of the mechanism relatively independent of the transmission and amplitude properties of the sound from the ship. The operational use of the phase discriminator or detector of the instant system provides firing intelligence which depends upon the factors of speed, abeam distance, depth, length of expected target sound source, and not on the use of the inherent loudness of the sound.

The loudness characteristic as heretofore utilized for target detection varies greatly from ship to ship and frequently results in "wild firing". Prior art passive acoustic influence discriminators generally fail to meet presently desired requirements in at least two major respects, i.e., they tend to lack response against the slow-speed quiet vessel operating at 6 knots or less such as battery operated submarines since they generally require a signal of at least 10 microbaryes pressure and because of the sensitivity thereof to improved countermeasures presently available, they are more easily swept now than when they were originally developed. Moreover in the event they are not swept by such countermeasures as single shot and multiple shot explosives they may be readily rendered passive by the use of a motor-driven hammer beating on a metal plate at a selectively variable rate and dragged through the water of the type commonly known as hammer boxes or devices which vary the sound output of a noise producing device, or by use of multiple graded explosives and similar procedures. These difficulties in providing reliable actuation of a mine in response to a slowly moving vessel appear to be inherent to the use of detectors for sound pressure fields and particularly at the frequencies of interest for mine purposes, since the acoustic pressure signature apparently contains no intelligence regarding the direction of arrival of the sound wave. Prior art acoustic mechanisms operate from the pressure signature of the vessel and have utilized the magnitude, rate of change of magnitude of sound pressure, rates of change of the log of the magnitude of sound pressure or combinations thereof.

The basic principles of operation of the system of the instant invention reside in continuously comparing the relative phase changes between two simultaneously detected acoustic velocity signals received from a sound source by a dual hydrophone system having cosine or "dumbbell" shaped response patterns and disposed with the respective axes of maximum response thereof mutually normal. The hydrophone system is constructed in a manner to receive two, preferably horizontal, vectorial components of the sound velocity.

The hydrophone assembly consists of two velocity sensitive microphone elements oriented at right angles in a desired plane corresponding generally to the plane of travel of the moving sound source and preferably housed in a neutrally buoyant spherical housing attached as by a cable to a moored mine. Utilizing this system it has been verified experimentally that the relative phases of the two components of sound velocity are either in phase or 180° out of phase for all frequencies in the frequency range of interest, which frequencies are sufficiently far removed from the natural resonant frequency of the pickup element. As a source of substantially continuous sound, such for example as from a slowly moving submarine or ship, passes the hydrophone axis there is an abrupt change in the relative phase of the signals from the two hydrophones. The operation of comparing the phases is a continuous one and is accomplished automatically by the phase discriminating detector and averaging circuit of the instant invention as will hereinafter become more clearly apparent. In this manner, the angular position of the target vessel may be determined at the time of crossing of the neutral or electrical axis of either hydrophone.

The utilization of a pattern array comprising two hydrophone pairs, with one pair having the neutral axis of each of the first two hydrophones shifted 45° with respect to the neutral axis of each hydrophone of the other pair, is such that the sound emitted with the passage of a ship in the vicinity thereof may be timed by the actuation channel circuits connected thereto through any 45° sector of the horizontal plane about the mine by the expedient of measuring the time interval between the axis crossings of the two pairs of hydrophones. In practice, the second pair of hydrophones are generally not required since movement of a continuous sound source accompanied by a vectorial axis crossing will provide a sufficient indication of a moving ship and discrimination against non-continuous ambient transient sounds for purposes of mine firing. Also the use of pattern shifting networks will provide a means for obtaining an angular position indication and facilitate a measuring of the proximity of the target vessel proportional to the time rate of change of the angular bearing of the target vessel referred to the detector axis.

Also it is to be understood that the system is adaptable to the use of a third pair of hydrophones oriented in a vertical plane to localize the sound source in the X, Y and Z axes if desired. It is also deemed obvious that a vertical vector and a horizontal vector may be considered in a system using only one pair of hydrophones if desired as for purposes of providing an anti-sweep mine or in harbor defences wherein a 360° horizontal response field is not required.

One object of the invention resides in providing a passive mechanism for accurate mine firing on slow moving ships in which the foregoing disadvantages of prior art systems are obviated while providing an improved discriminator system which is unaffected by the ambient energy level in the acoustic pressure field.

Another object of the invention is to provide a passive mine mechanism with improved signal to noise ratio, which mechanism utilizes a cross correlation of signals derived from the velocity vectors of the acoustic field of a ship passing in the vicinity thereto.

It is a further object of the invention to provide a system which requires a moving sound source to provide a firing actuation of the discriminator circuit thereby providing improved discrimination with respect to countermeasures utilizing stationary sound sources or towed pressure field simulators providing transient fields of a non-continuous nature.

Another object of the invention resides in a mine detecting system providing improved localization characteristics over systems heretofore or now in general use.

Another object of the invention is to provide a system in which the actuation characteristics for mine firing are independent of the loudness of the target vessel.

It is also an object of the invention to provide a mine firing mechanism having actuation characteristics substantially independent of the random orientation of the hydrophone casing of the instant invention.

Another object resides in the provision of a system requiring no additional anti-countermine circuit.

A further object resides in providing a passive detector mechanism for use with an active system which makes a determination that the target is moving and thereafter provides intelligence for actuation of the active system.

Other objects which are inherent in the instant system relate to the provision of a mechanism having low electrical current drain requirements which is possessed of long life and characterized by economy and ease of manufacture.

Other objects and many of the attendant advantages of this invention will be readily appreciated as the same becomes better understood by reference to the following detailed description when considered in connection with the accompanying drawings wherein:

FIG. 1 is a diagrammatic illustration showing the geometry of the velocity vector relationships of interest in a sound pressure field of a ship moving through a body of water in proximity to the orthogonally disposed hydrophone detection system of the instant invention;

FIG. 2 is a group of curves showing the comparison of traces (a) and (b) of the rectified beam response patterns of each of a pair of velocity sensitive hydrophones to signals produced in a sound field adjacent thereto; (c) the detected on course rectified and filtered trace with an axis crossing and (d) a curve of the omnidirectional pressure energy level in the acoustic field as obtained with a pressure sensitive hydrophone;

FIG. 3 is a group of characteristic curves (e) and (f) showing the changes in vectorial response of the rectified and filtered sound velocity signals impressed upon two hydrophones in an orthogonal array as a Diesel operated submarine moves at a speed of 8 knots and at a distance of 65 feet relative thereto and in the acoustic pressure field and further shows an output curve (g) of the electrical product of the signals as picked up by the two hydrophones and after cross correlation thereof in the phase discriminator detector circuits of the system of the instant invention;

FIG. 4 is a graphical showing of a set of curves similar to FIG. 3 but of a pair of rectified and filtered output signatures (h) and (i) respectively received by the two velocity hydrophone units for a slowly moving electric submarine moving at 6 knots and at a distance of 25 feet with respect to the instant mechanism; and a pair of curves of the phase discriminator outputs (j) and (k) for signatures of curves (h) and (i) and further showing the time lag between the two axis crossings corresponding to the time distance travel relationship of the vessel and providing an indication of the relative proximity of the ship to the detection system.

Figure 6:
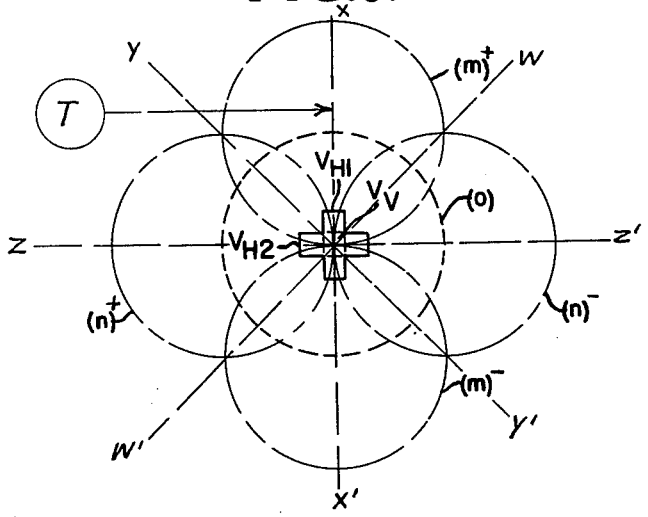
FIG. 6 is a graphical illustration showing the polar response patterns (m) and (n) of a pair of horizontally disposed velocity pickups $V_{H1}$ and $V_{H2}$ respectively, together with the polar response pattern (o) of the vertically disposed hydrophone $V_V$ and having cosine response characteristics.
Figure 7:
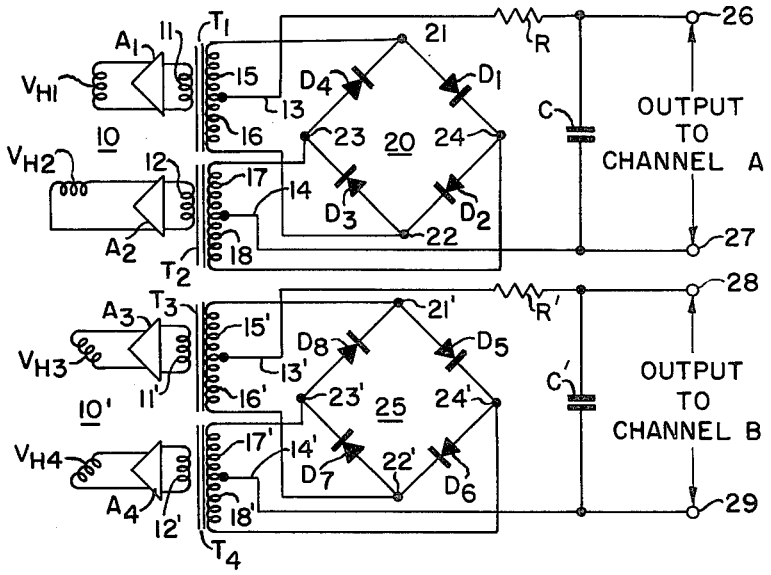
FIG. 7 is a schematic diagram of a dual channel input circuit incorporating two sets of hydrophones and a pair of ring demodulators and averaging circuits as utilized to provide a mine firing signal correlative to movement of the target vessel through a predetermined time-distance relationship.
Figure 8:
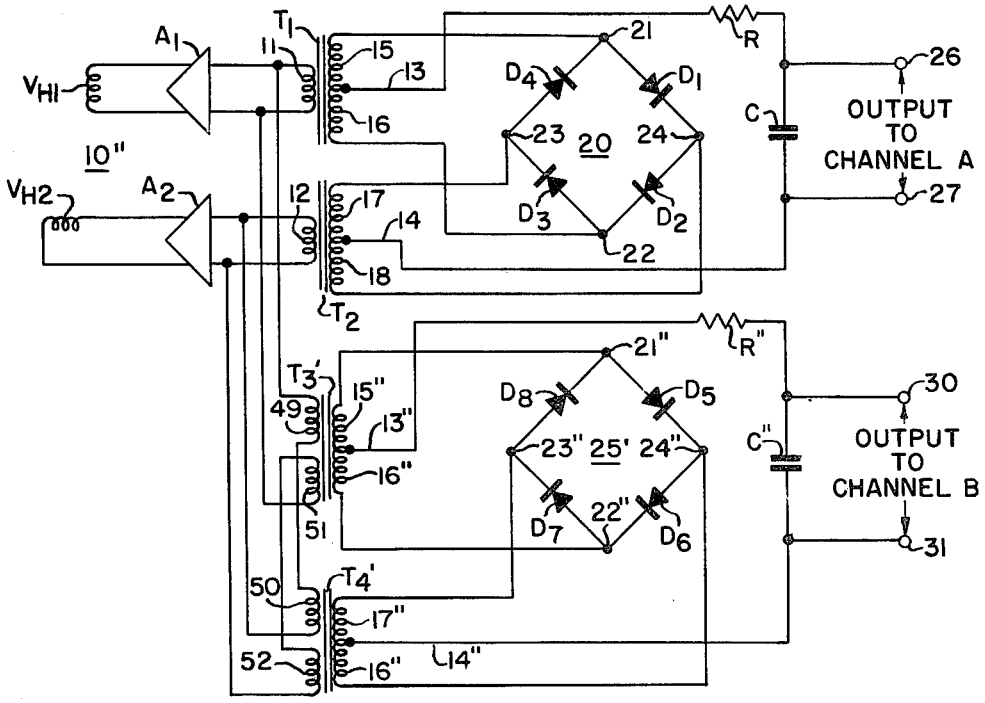
Figure 9:
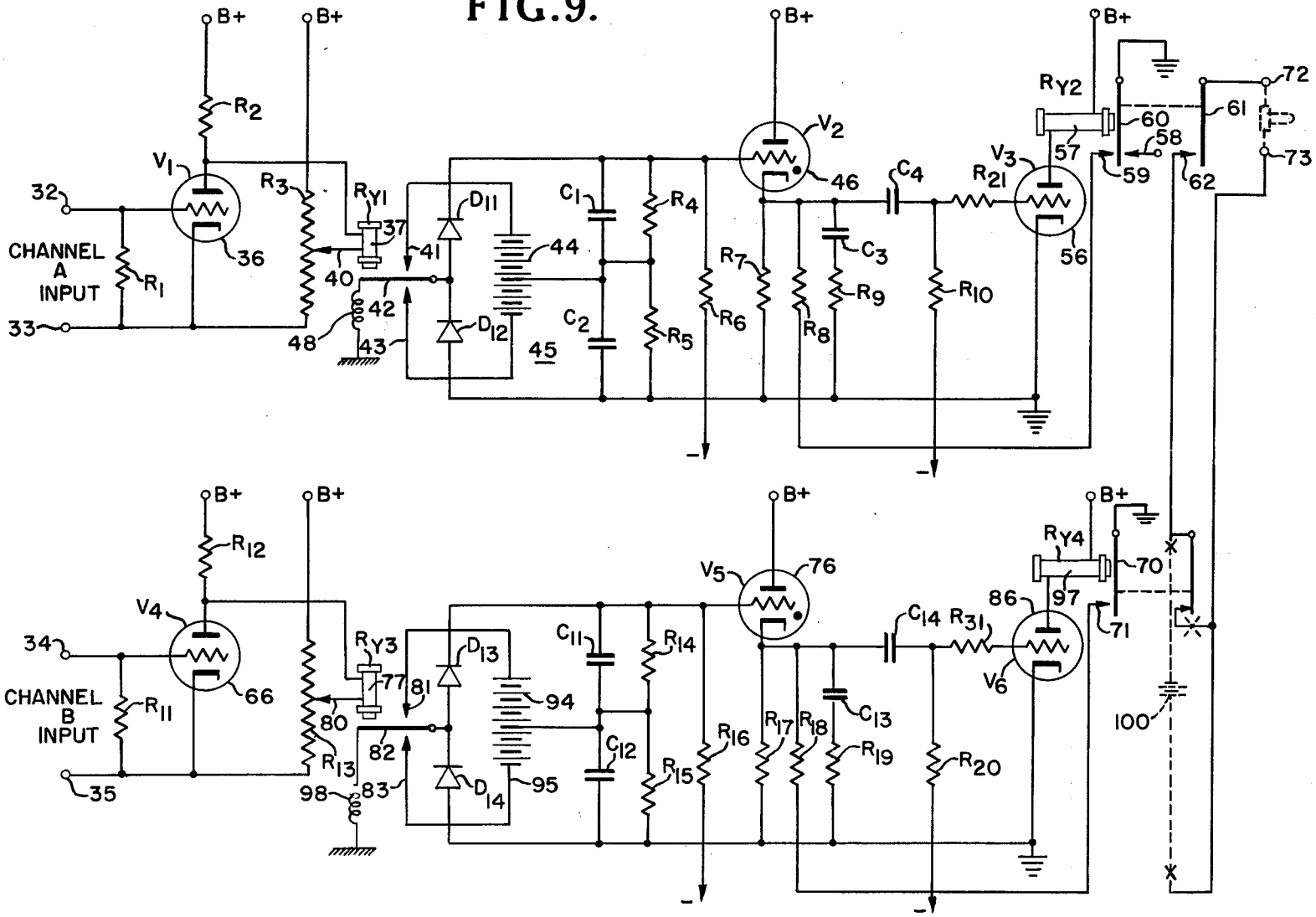

FIG. 8 is a schematic diagram of a dual ring demodulator input and averaging circuit for providing a dual channel phase shifted output of the character of the circuit of FIG. 6 by the use of a phase shifting network to obviate the use of an extra pair of velocity pickups or hydrophones; and FIG. 9 is a schematic diagram of a dual channel output circuit of a character for providing a mine firing signal in response to dual channel actuations as provided by the input circuits of FIGS. 7 or 8 in response to target movement through a 45° angle with respect to the pattern axes of the two pickups.

Referring now to FIG. 1 there is shown the geometry for a mine assembly at 1 having an anchor 2 bottoming on the surface of the bed 3 of the ocean and having a hydrophone mounting shown at 4 and which is preferably disposed within the mine although it is shown displaced therefrom for purposes of clarity as by the dashed line 5. The two or three velocity sensitive microphone pickups 6 and 7 and/or 8, as the case may be, are disposed for reception of sound velocity signals produced in the acoustic pressure field, as a slowly moving submarine or ship 9 moves with respect to the hydrophone system. The hydrophone system advantageously incorporates at least one pair of velocity sensitive hydrophone units having cosine response patterns and respectively disposed with the axis of maximum sensitivity thereof in mutually normal or orthogonal relation as shown in FIG. 6.

The vector relationships, shown with reference to a common point above the hydrophone mount in FIG. 1 rather than from the hydrophones proper, for purposes of clarity, are such that the distance a ship moves in a given time is represented by line ct and the moving or rotating vector is represented by $N_1$ and $N_2$ corresponding to the initial and final timing positions. This vector moves in the vector field of the hydrophones $V_{H1}$ and $V_{H2}$ and $V_V$ if the latter is used. The two upper curves of FIG. 2 respectively indicate the vector energy from the sound source as the ship moves abeam into the pickup position for $V_{H1}$ and $V_{H2}$ in the acoustic field. The third curve shows a typical response trace of the "on course" vector from the initial to the final position of the ship with an axis crossing for either of the hydrophone units. It will hereinafter become apparent that by using a system providing an output representing two axis crossings as 45° angles with respect to each other a timing may be obtained for the travel of the vessel between these 45° positions and a distance or proximity relationship for the vessel may be measured. The line d of FIG. 1 represents the vertical height of the hydrophone to the surface of the water and b represents the horizontal abeam distance from the hydrophone to the termination point for the timing. As indicated in FIG. 6, hydrophone $V_{H1}$ having a cosine response pattern indicated by lobes [m]+ and [m]−, is orthogonally disposed with respect to the hydrophone $V_{H2}$ having a response pattern indicated by lobes [n]+ and [n]−. Accordingly, lobes [m]+ and [m]− lie on opposite sides of line Z—Z', the axis of maximum sensitivity of hydrophone $V_{H2}$, while lobes [n]+ and [n]− lie on opposite sides of the axis of maximum sensitivity of hydrophone $V_{H1}$, X—X'. It is apparent therefore that when a target T progresses across X—X' in the direction shown in FIG. 6, it will move from the quadrant of the sea wherein the hydroacoustic signals from the target are picked up by lobes [m]+ and [n]+ to that wherein it is received at lobes [m]+ or [n]−. The relative phase of the outputs of $V_{H1}$ and $V_{H2}$ therefore reverses upon this axis crossing. Furthermore, this phase reversal occurs at each axis crossing. This phenomena may be used to indicate the instant at which a target following a path similar to that of target 'T' has moved abeam of the hydrophone array. It should be obvious that when a second hydrophone array having perpendicular axes Y—Y' and W—W' disposed at 45° to axes X—X' and Z—Z' is added to the hydrophone array, it is possible to measure the time required by a target to successively cross one of the X—X' and Z—Z' axes and one of the Y—Y' and W—W' axes. The longer this time is, the greater the target is from the intersection of the axes [i.e. the center of the hydrophone array]. Accordingly, if this time is greater than a certain preselected maximum, the target is known to be outside the lethal range of the mine. The electrical circuitry for timing out these axis crossings is explained in detail hereinbelow.

Figure 5:
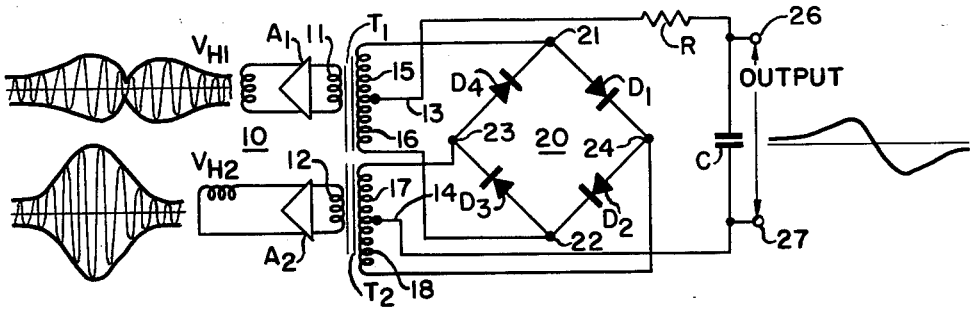
FIG. 5 is a schematic showing of the basic phase discriminator or ring demodulator type cross-correlation input and averaging circuit of the instant invention as utilized to determine movement of a target vessel.

Referring now to the inputs and phase discriminator portions of the basic circuit as shown in FIG. 5 for providing an indication of movement of a target vessel-there is shown a dual channel input arrangement at 10 comprising hydrophones $V_{H1}$ and $V_{H2}$ with each hydrophone connected to a suitable amplifier as shown in block form at $A_1$ and $A_2$ and with the amplifier outputs connected to feed the primary windings 11 and 12 respectively of the input transformers $T_1$ and $T_2$ having center taps at 13 and 14 for secondaries 15, 16 and 17, 18 in each of two ring demodulator input circuits. Thus two signals in the input circuits of the dual channel system are resolved into two horizontal orthogonal components of the acoustic velocity, and are adapted to be correlated in the ring demodulator circuit 20 from two hydrophone detector units corresponding to $V_{H1}$ and $V_{H2}$.

The hydrophone inputs which provide a cosine response pattern as a result of the use of a mechanical system having a single degree of freedom rather than a difference in phase at the frequencies of interest are each amplified and transformer coupled to feed to two separate pairs of junctions 21, 22 and 23, 24 of the diode bridge circuit 20 having the asymmetrically conducting diodes $D_1$ to $D_4$ thereof mutually connected in series relation to provide a ring cross correlation or product circuit hereinafter referred to as the ring demodulator. The secondaries of each of the input transformers $T_1$ and $T_2$ are provided with center taps 13 and 14 between the two balanced secondary windings 15, 16 and 17, 18 thereof. The load circuit of the diode ring demodulator arrangement 20 is connected between the two center taps 13 and 14 of the transformer secondaries. A suitable integrating R-C filter circuit comprising resistor R and capacitor C is connected in series with the output of the ring demodulator to provide an averaging of the output signal level. The manner of connecting the terminal ends of the secondary windings as shown in FIG. 5 is such as to provide a current through the load resistance element $R_1$ of FIG. 9 which current is proportional to the product of the two voltages applied to the ring across the respective pairs of transformer secondary terminals. The theory of operation of the ring demodulator circuit to provide a multiplication function is set forth in greater detail in the article by R. H. Wilcox in the October 1954 issue of Proceedings of IRE on pages 1512 to 1515 thereof and in publications such as R. H. Wilcox, "Crystal Diode Ring Multipliers", NRL Report 4385, June 1954 mentioned in the footnotes thereof. As heretofore stated the ring demodulator circuit terminates in an integrating filter arrangement to provide a smoothing or averaging of the output waveform response thereof with the components thereof selected to provide a suitable time constant of approximately 4 to 6 seconds. It will now be apparent from the foregoing and the curve 3(*g*) of FIG. 3 that an axis crossing will be obtained by one of the hydrophones for a signal source moving abeam with respect to the system and the output response of the ring demodulator circuit will be as shown at the output thereof when an out of phase relationship exists between the signals being fed thereto from the pair of hydrophones.

Referring now to FIG. 7 there is shown a circuit utilizing two systems of FIG. 6 with the hydrophones oriented at 45° with respect to the channel corresponding to FIG. 6 wherein the individual time integrated output signals of the two phase discriminator or ring demodulator circuits may be fed to the inputs of channels A and B as shown on FIG. 9 with the timing out of vessel travel corresponding to the phase differences of these two voltages with respect to time. Thus for a ship moving in the field of the system it will be apparent that the dual ring demodulator circuit of FIG. 7 will effectively provide an initial axis crossing in channel A for a given direction of ship travel and within a predetermined time thereafter, as determined by the time required for the ship to move through a 45° angle as shown in FIG. 1 a second axis crossing will be produced by the ring demodulator for channel B. A polarity difference or reversal of order of axis crossings in channels A and B will occur with differing directions of vessel approach.

The output of the ring demodulator circuit A of FIG. 7 is integrated and amplified by an electronic amplifier stage $V_1$ of FIG. 9. In an illustrative embodiment of an actuation circuit a plate sensitive relay $R_{Y1}$ is disposed as shown at 37 in the plate circuit output of tube 36 in stage $V_1$. This relay is connected to the tap 39 of voltage dividing potentiometer $R_3$ with the wiper at 40 to preset a level of quiesent current response therefor to overcome the bias of spring 48 only by an amount sufficient to maintain the armature 42 in a neutral position. As the relay at 37 in this circuit is energized by the A.C. components of the plate current with polarity changes in the grid circuit of tube 36, the armature 42 there is moved from a normally open position to close a contact 41 or 43 as the case may be in a floating battery triggering circuit at 45 for gas tube $V_2$. This circuit functions with each complete cycle of contact reversal of relay $R_{Y1}$ to apply the battery voltage as a stepped signal to the grid of the gas triode tube 46 of stage $V_2$ as hereinafter described in greater detail and which tube 46 has a time delay filter comprising resistance and capacitance elements $C_3$ and $R_9$ connected across the cathode output circuit thereof. This cathode follower stage $V_2$ feeds a filtered or integrated signal to the triode relay tube 56 of stage $V_3$ which when rendered conducting causes a current to flow from B+ through the relay coil 57 in the load circuit thereof to move the dual armatures 60 and 61 to close with a pair of contacts 59 and 62 in the actuating circuits connected to the armatures 60 or 61 thereof.

The arrangement of the relay $R_{Y2}$ contacts is such that a bleed off circuit is closed to provide a lower resistance discharge path from the charged condenser $C_3$ through resistor $R_8$ to ground through contacts 59 and 60. This bleed off circuit functions to reduce the closed time of $R_{Y2}$ by reducing the positive signal on the grid of tube 56. The second relay armature 61 makes with contact 62 to provide for energization of a detonation or response circuit, not shown, from a potential source or the like as indicated generally by the dashed line portion of the circuit for battery 100. When armature 61 and contact 62 are to be utilized in a dual channel control circuit the battery 100 may be eliminated and the armature 70 and contact 71 of relay $R_{Y4}$ substituted therefor in a manner as shown and for a purpose which will hereinafter become apparent.

The second channel B is utilized when it is desired to "time-out" the movement of a vessel between two axis crossing conditions for signals from hydrophones $V_{H1}$ and $V_{H2}$ disposed with the axes of the response patterns thereof at right angles.

Figure 4:
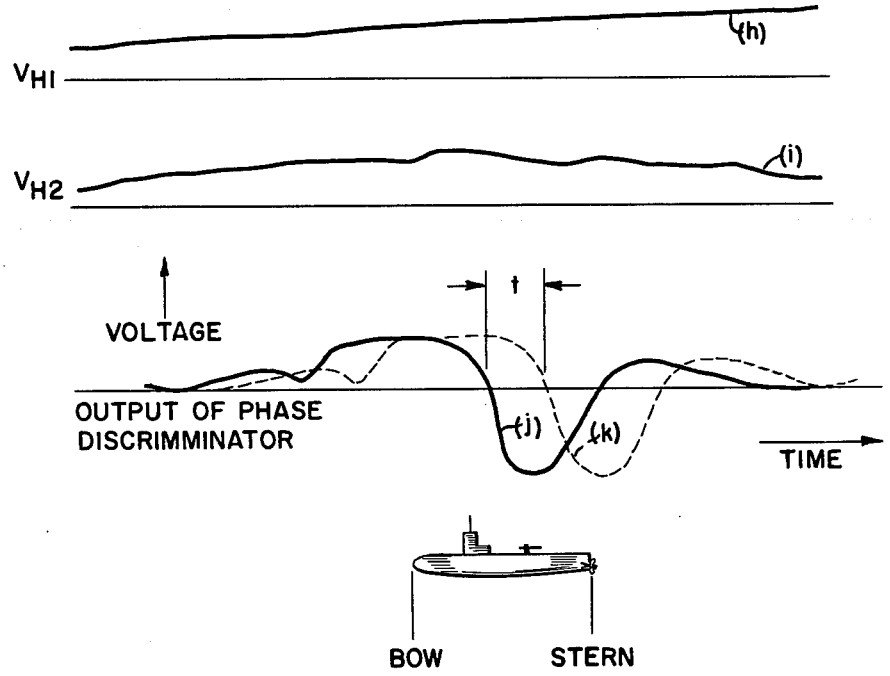

The signal from the ring demodulator 25 or 25' for channel B is applied in a like manner to amplifier $V_4$ and to the thyratron circuit arrangement of $V_5$ of channel B to provide a similar actuation of the relay $R_{Y4}$ in the output circuit thereof. Since the signal in channel B is advanced or delayed with respect to the signal in channel A the relays $R_{Y3}$ and $R_{Y4}$ will be actuated during a variable period of time (t), see FIG. 4, before or after the relays $R_{Y1}$ and $R_{Y2}$ in channel A, as the case may be, thereby closing the circuit through the armature 70 and contact 71 and providing one circuit portion closure for an arming and for an ultimate firing signal for the mine by means of a suitable mixer circuit arrangement or detonator connected in series with the output 72 and 73. The relay circuits of $R_{Y2}$ and $R_{Y4}$ are both connected through respective shunt bleed off resistances $R_8$ and $R_{18}$ to the respective cathode circuit of the gas triode tubes 46 and 76 to bleed off a firing signal after a predetermined period of time, thereby reactivating the system in the event that the two signal in the ring demodulator channels A and B do not provide a firing actuation within a predetermined period of time after either the channel A or channel B is rendered operative.

It will be apparent that each channel of the system operates to provide an axis crossing for use by the output circuit with movement of a signal source in the field of the two microphones and that the positively increasing current amplitude in the channel must be followed by a negatively increasing signal current after the axis crossing to provide the voltage stepping action of applying half the battery voltage of batteries 44 and 94 in sequential steps to provide a buildup of voltages in the grid circuits of the stages 45 and 95 for the tubes 46 or 76 for rendering the gas triode thyratron stages in $V_2$ and $V_5$ in each channel active to conduct a signal for timing out in the integrator filter circuit thereof for actuation of the firing relays $R_{Y2}$ and $R_{Y4}$ in the outputs of the respective channels thereof. It is further deemed apparent that while a time delay in the second channel is provided by a suitable phase shift of the signal of the ring demodulator 25 or 25' and input circuit 10' or 10'' thereof with respect to the output signal of the ring demodulator 20 of the first or A channel, a means is provided for timing the movement of a ship through a 45° angle and thereby giving a positive firing indication for a slowly moving vessel producing an acoustic field ambient to the hydrophone detector system.

Referring now to FIG. 8 there is shown a different ring demodulator input circuit for feeding an output to a dual channel firing circuit of FIG. 9, and in which signals from only the two hydrophones $V_{H1}$ and $V_{H2}$ are adapted to be fed into the transformer coupled phase shift networks of transformers $T_{3'}$ and $T_{4'}$ to provide for coupling to and outputs from the two channels A and B respectively of the ring demodulator circuit 25'. This circuit includes the amplifiers $A_1$ and $A_2$ and the dual primary center tapped secondary transformers $T_{3'}$ and $T_{4'}$ having the primaries 49 and 50 of $T_{3'}$ and $T_{4'}$ connected in series aiding relation and in parallel with primary winding 11 of transformer $T_1$. The primary windings 51 and 52 of transformers $T_{3'}$ and $T_{4'}$ are connected in series opposing relation and in parallel with primary winding 12 of transformer $T_2$.

As in the case with the circuit of FIGS. 7 and 9 each channel comprises a first triode stage $V_1$ or $V_4$ respectively having a grid return resistance $R_1$ or $R_{11}$ connected between the grid and cathode of tubes 36 or 66 and with a load resistance $R_2$ or $R_{12}$ connected in the plate circuit between B+ and the respective tube plates. The outputs of both of these circuits are connected through the coils 37 or 77 of relays $R_{Y1}$ or $R_{Y3}$ respectively to the aforementioned variable taps of the bleeder resistances $R_3$ or $R_{13}$ each of which is connected from B+ to ground to provide a predetermined operating level for the relays $R_{Y1}$ and $R_{Y3}$. The armatures of the relays are disposed in a normally open relationship with respect to a pair of opposedly disposed contacts 41 and 43. These contacts are connected from a battery supply at 44 or 94 to provide a circuit across half of the battery to one of the contacts on the relay when energized with a particular push or pull direction as determined by the polarity of the effective a-c component in the plate circuit of the tube $V_1$ or $V_4$ as the case may be. The current flow in one instance is through the diode $D_{11}$ or $D_{13}$ to charge the condenser $C_1$ or $C_{11}$ of the voltage stepping circuit generally indicated at 45 or 95 in the grid circuit of the gas triode thyratron tubes $V_2$ or $V_5$. Under signals of opposite polarity the current flow is such as to charge the condensers $C_2$ or $C_{12}$ through a charging path including resistor $R_5$ or $R_{15}$, a diode $D_{12}$ or $D_{14}$, the armature of the relay $R_{Y1}$ or $R_{Y3}$ and contacts 43 and 83 to the return lead of the negative side of the battery 44 or 94. This circuit arrangement applies a signal voltage in two steps which reaches a value which is approximately equal to the battery voltage and of sufficient potential to overcome the negative bias applied through $R_6$ or $R_{16}$ and to trigger the thyratron following energization of the relay in either direction. It thus provides a stepping application of the signal voltage for triggering action and correlative with an axis crossing of the signal (g), FIG. 3. This action occurs only with a polarity change actuation of the relay $R_{Y1}$ or $R_{Y3}$. The negative grid bias applied through resistors $R_6$ and $R_{16}$ of the thyratron tube stages $V_2$ and $V_5$ is of such value as to render the thyratrons normally nonconductive with the application of a normal firing potential from B+ across the gas tube. When the stepped positive grid signal is presented in opposition to the negative bias applied to the grid circuit thereof the tube conducts. When the gas tube is rendered conductive it remains conducting until subsequently cut off by effectively removing the plate current flowing therethrough as by a reset circuit not shown but which may be operated by additional contacts on $R_{Y2}$ if desired. The d-c current flowing in the cathode follower output load resistors $R_7$ and $R_{17}$ of these tubes is filtered by means of the shunt connected series capacitance and resistant circuit aforementioned and this integrating network is capacitance coupled to the output tube stage in each channel indicated as $V_3$ and $V_6$. The output tubes 56 and 86 are biased from a suitable negative bias source applied through grid resistances $R_{10}$ and $R_{20}$ and applied through limiting resistance elements $R_{21}$ and $R_{31}$ to the tube grids. When either of these tubes is rendered conducting with conduction of the gas thyratrons it functions to energize the coil or relays $R_{Y2}$ and $R_{Y4}$ from the B+ supply with current flow therethrough when the tube has been rendered conductive. In the armature and contact circuit of channel A, one contact and one armature thereof is connected to ground and when the relay is energized to close a circuit to tube bleeder resistance $R_8$ to the cathode of the thyratron tube $V_2$ thereby bleeding off the signal to the output tube after a predetermined time. A second armature contact is connected to one output terminal and the contact made thereby with energization of relay $R_{Y2}$ is connected to the armature of relay $R_{Y4}$. This closes a contact to the other side of the output circuit and also shunts a bleed-off resistance $R_{18}$ in the cathode circuit of tube 76 similarly as in the case of the thyratron $V_2$ in channel A. It will thus be apparent that when channel A is energized channel B must likewise be energized thereafter and within a predetermined time as determined by the bleed-off resistance constants in order to close the relays $R_{Y2}$ and $R_{Y4}$ and close the second contact of the firing circuit. In the event an actuation of circuit B precedes circuit A as when the ship is approaching from the opposite direction the signal in channel A must be such as to fire the thyratron and actually relay $R_{Y2}$ a predetermined time after energization of channel B and before bleed-off of the signal on the output tube in channel B to effect the firing. It is to be understood that the firing circuit includes a source of potential connected in series through the two relay armatures and a suitable detonator included therewith in a conventional manner.

Obviously many modifications and variations of the present invention are possible in the light of the above teachings. It is therefore to be understood that within the scope of the appended claims the invention may be practiced otherwise than as specifically described.

What is claimed as new and desired to to be secured by Letters Patent of the United States is:

1. A submarine mine actuating system responsive to the acoustic pressure signature of a target vessel moving through the water in the vicinity of the system comprising; an array of hydrophones including a first velocity hydrophone having a cosine response pattern and generating an electric signal in response to received underwater acoustic signals originating from said target vessel, and a second velocity hydrophone having a response pattern similar to that of said first hydrophone and disposed in orthogonal relation therewith whereby the axes of maximum sensitivity of said hydrophones are mutually perpendicular so that the signals produced by said hydrophones undergo a phase reversal as the target vessel crosses an axis of maximum sensitivity of one of said hydrophones; a pair of transformers each having a primary coil coupled to the output of a respective one of said hydrophones to receive an output signal therefrom, a ring demodulator circuit having a first and a second pair of input terminals each connected across the respective secondaries of said transformers, a center-tap at each secondary winding of said transformers for providing an output signal from said demodulator circuit correlative to the phase relationship of the signals applied across the input terminals of said circuit to thereby indicate a phase reversal of the received acoustic signal as the target vessel cross the axis of one of said hydrophones of said array.

2. A submarine mine actuating system responsive to the acoustic pressure signature of a target vessel moving through the water in the vicinity of said system comprising; an array of hydrophones including a first pair of orthogonally disposed velocity hydrophones and a second pair of orthogonally disposed velocity hydrophones oriented at 45° with respect to said first pair, a first ring modulator circuit having two pairs of input terminals connected to the respective first pair of hydrophones for providing an output signal of polarity depending upon the phase relation of the signal applied to said input terminals, a second ring modulator circuit having two pairs of input terminals connected to the respective second pair of hydrophones for providing an output signal of polarity dependent upon the phase relation of the signals applied to the input terminals of said second ring modulator circuit, a dual channel utilization circuit for firing a mine having a first of said channels connected to the output of said first ring modulator system and a second of said channels connected to the output of said second ring modulator circuit, said first channel including a firing relay having high electrical resistance, a battery adapted to close said relay and normally unconnected thereto, and an actuating relay operatively connected to the output of said first ring modulator and responsive to a reversal of polarity of the output signal of said first ring modulator circuit for connecting said battery to said firing relay upon reversal of polarity of the output of said first ring modulator circuit; said second channel including a second firing relay having a high resistance, a second battery for closing said last-named relay and normally unconnected thereto, and a second actuating relay responsive to a reversal of polarity of the output signal of said second ring modulator circuit for connecting said last-named battery to said second firing relay upon reversal of the polarity of the output of said second ring modulator circuit; a detonator serially connected between said first and second firing relays and adapted to be actuated by the combined voltage of said batteries when the firing relay of said first channel and the firing relay of said second channel are both in the closed position.

3. The mine actuating system of claim 2 further including a resistor connected in shunting relation with each of the respective firing relays and having a low resistance relative thereto for providing a discharge path to deenergize and open the respective relay upon elapse of a predetermined time subsequent to the closure thereof.

4. A submarine mine actuating system responsive to the acoustic pressure signature of a target vessel moving through the water in the vicinity of the system comprising: an array of hydrophones including a first signal producing hydrophone having a cosine response pattern and a second signal producing hydrophone having a cosine response pattern and orthogonally disposed with respect to said first hydrophone in such manner that the signals produced by said hydrophones undergo a phase reversal as the target vessel crosses an axis of maximum sensitivity of one of said hydrophones, a transformer coupled addition and subtraction network operatively connected to the output of said array to add and subtract the output of said hydrophones thereby to effectively provide a second response pattern equivalent to that of a second array of two orthogonal hydrophones disposed at 45° to said first array, a pair of ring demodulator networks, one of said ring demodulator networks connected to the output of said first array, the other of said ring demodulator networks connected to the output of said addition and subtraction network, means for deriving an output from each of said ring demodulator circuits, and a dual channel firing system having a first channel connected to the output of one of said demodulator circuits and a second channel connected to the output of the other of said demodulator circuits, a pair of relays respectively disposed in said first and second channels and each adapted to be actuated by a phase reversal of the output from the respective ring demodulator circuit, a plurality of power sources respectively arranged in each channel, and a pair of firing relays disposed respectively in said first and said second channels and each potentially serially connected with the respective power source and adapted to be closed thereby for a predetermined period of time upon actuation of a respective one of said first named pair of relays, and means operatively connected between said firing relays to detonate the mine when both of said firing relays are closed.

5. A vector acoustic mechanism comprising, a first velocity hydrophone, and a second velocity hydrophone orthogonally disposed with respect to said first hydrophone for detecting the noise created by a target moving in the vicinity of the mechanism, each of said hydrophones producing an output when a target moves through the water in the vicinity of the mechanism, the phase of the output of one hydrophone abruptly changing 180° with respect to the output of the other hydrophone when the target crosses the axis of maximum sensitivity of the other hydrophone, and an electrical phase detecting network coupled to the output of each of said hydrophones to provide a signal indicative of a 180° relative phase reversal of the output of said first and said second hydrophones.

* * * * *